US005979652A

United States Patent [19]

Rösler

[11] Patent Number: 5,979,652

[45] Date of Patent: Nov. 9, 1999

[54] HANGING ELEMENT FOR TOOLS WITH AN SDS-SHANK

[75] Inventor: Peter Rösler, Wangen, Germany

[73] Assignee: Rose Plastic, GmbH, Hergensweiler, Germany

[21] Appl. No.: 08/951,398

[22] Filed: Oct. 16, 1997

[30] Foreign Application Priority Data

Oct. 16, 1996 [DE] Germany ..... 196 42 611

[51] Int. Cl.[6] ..... B65D 73/00

[52] U.S. Cl. ..... 206/481; 206/349; 206/495

[58] Field of Search ..... 206/461, 471, 206/349, 362.4, 477, 478, 481, 483, 495, 446

[56] References Cited

U.S. PATENT DOCUMENTS

| | | | |
|---|---|---|---|
| 3,280,969 | 10/1966 | Evans et al. | 206/446 |
| 3,404,774 | 10/1968 | Levine | 206/477 |
| 3,809,226 | 5/1974 | Ferrari | 206/349 |
| 3,885,667 | 5/1975 | Spiegel et al. | 206/461 |
| 4,331,237 | 5/1982 | Edell | 206/461 |
| 4,508,225 | 4/1985 | Ferrari | 206/461 |
| 4,634,005 | 1/1987 | Kulzer et al. | 206/477 |
| 4,729,473 | 3/1988 | Kulzer et al. | 206/477 |

FOREIGN PATENT DOCUMENTS

| | | |
|---|---|---|
| 0 609 522 A2 | 8/1994 | European Pat. Off. . |
| 94 19 537 U1 | 7/1995 | Germany . |
| 195 17 519 A1 | 11/1996 | Germany . |

*Primary Examiner*—Paul T. Sewell
*Assistant Examiner*—Nhan T. Lam
*Attorney, Agent, or Firm*—Frederick L. Tolhurst

[57] ABSTRACT

An element for hanging tools that have an SDS-shank wherein the hanging element includes a lug (1) and an elastically-deformable sleeve-like body (3, 30). Body (3, 30) includes at least one bulge or fold (12) that defines a clearance (20). Body (3, 30) also includes at least one protrusion (18) that engages a flute of the SDS-shank to retain the SDS-shank in body (3, 30). Clearance (20) allows body (3, 30) to deform when the SDS-shank is inserted therein.

32 Claims, 3 Drawing Sheets

HANGING ELEMENT FOR TOOLS WITH AN SDS-SHANK

The present invention relates to a hanging element with an SDS-shank according to the preamble of claim 1.

We will begin by explaining the term SDS-shank. This is a special shank belonging to tools, e.g. drills, milling cutters, chisels, etc., which can be introduced into a so-called SDS-plus-holder or holders of similar design. The SDS-shank is of essentially cylindrical design and has two flutes which are parallel to the axis of the tool and are located opposite one another, that is to say are offset by 18020 with respect to one another. These flutes extend over a specific length of the shank and, at the two ends, merge into the cylinder surface via a rounded section. They are thus closed at the two ends.

It is frequently the case that the shank is additionally provided with one or more longitudinal grooves which extend into the end surface of the shank, that is to say are open on one side. This grooves likewise run parallel to the longitudinal axis of the tool.

The cross-section of the flutes is approximately arcuate or trough-shaped, while the cross-section of the grooves is approximately rectangular or trapezoidal.

For sales purposes, these tools are packaged in plastic pockets which are hung, in shops, on appropriate carriers by way of a perforated lug. These plastic pockets have become known in a series of designs.

A first pocket comprises a sleeve which fully encloses the tool. Material consumption is high and the closure elements of the sleeve quickly wear out. Regular reuse is not possible.

DE-U 94 10 538.3 describes a device for hanging tools with a grooved shank. It is assumed here that the shank contains both flutes and grooves. DE-U 94 10 538.3 uses retaining arms which engage in the grooves and retaining protrusions which engage in the flutes. The retaining arms and retaining protrusions are fitted on retaining brackets, are relatively rigid and basically do not spread out when the tool is introduced. A large amount of force is required to deform the hanging device when the tool is pushed in and removed; the retaining protrusions wear out. Regular reuse is not possible here either.

DE-A-195 17 519 deals with a holder for an object, the holder having an elastic ring. This ring is curved inward on at least one section of its circumference, and this section can come to rest in a groove or flute of a shank. This design is better suited for regular reuse than the ones mentioned in the introduction. The disadvantage, however, is that elastic deformation is only possible with specific shanks, namely when the interior of the ring is not filled completely. Nevertheless, it is then only an unsatisfactory retaining action which takes place. Furthermore, it is questionable here whether the deformation which is possible is sufficient at all for insertion or removal without damage to the ring or to the inwardly projecting section.

The object of the present invention is thus to develop a hanging element of the type mentioned in the introduction to the effect that reliable and sufficient elastic deformation is possible. It should be possible for a tool or a shank of a tool to be inserted and removed on a regular basis without damage.

According to the invention, this object is achieved by the technical teaching of claim 1.

The essential feature here is that, rather than just being an elastic body with at least one protrusion, but preferably two protrusions, on its inside, the hanging element is additionally provided with at least one clearance, although preferably a plurality of clearances are used.

When the shank is introduced into the interior of the body, the latter deforms elastically. The clearances serve for this purpose. The protrusions come to rest in the flutes of the shanks. Since these flutes are closed toward the end of the shank, the entire tool is retained securely as a result. The protrusions are not damaged in any way. The tool can easily be introduced and removed repeatedly without the quality of the retaining means being impaired.

For introduction purposes, the tool is turned such that the protrusions engage in the grooves, which are open at the top. The tool is then pushed in and subsequently turned. The body widens as a result, and the protrusions slide along the outer circumference of the shank and finally come to rest in the flutes. The body then springs back elastically essentially into its original shape.

The body may be designed to be round, oval or polygonal. The protrusions may extend over the entire length of the body or over only part of the length. In the first case, the protrusions are preferably beveled on that side of the body which is directed away from the hanging lug, that is to say the underside of the body; in the second case, the protrusions are preferably designed approximately in the form of a wedge.

The protrusions are preferably dimensioned such that, on that side of the body which is directed toward the hanging lugs, that is to say the top side of the body, there is a thickness which is at least two and a half times the wall thickness of the body.

The inside width between the clearances is preferably at least double the wall thickness.

In order to facilitate turning, the hanging lug and the body are connected via webs which extend at least to the center of the body. Said webs are preferably arranged so as to be offset by 90° with respect to the clearances.

In order to compensate for tolerances on the shank, the body may be provided on its inside with a multiplicity of elevations. In comparison with the protrusions, these are small and they are designed as studs or the like.

The dimensions of the body are preferably selected such that its length corresponds essentially to the internal diameter in the non-deformed state. If a body which has corners is used, the length preferably corresponds approximately to the diagonals. With other body shapes, the length corresponds approximately to the average value of the largest and smallest extents.

Since, according to the invention, the annular element, which tightly encloses the tool shank, is designed as a sleeve-like body which is produced from elastic material and in the rest state, i.e. in the non-deformed state, of the hanging element exhibits in each case one clearance in two diametrically opposite regions outside the shank surface area, said clearances being offset by 90° in each case with respect to the at least one retaining part engaging in a flute in the tool shank, it is possible for the sleeve-like body to deform elastically when the tool shank is introduced, i.e. to resume its original configuration once the force causing the deformation has been eliminated. During this deformation, parts of the inner wall surface of the sleeve-like body are always in pressurized abutment with the surface of the tool shank, with the result that a certain degree of tensile stressing prevails in the sleeve-like body and always ensures a firm fit of said body against the tool shank. The deformation of the sleeve-like body is caused by the SDS-shank of the tool being introduced into it, there being two possibilities for this: namely mechanical or automated introduction and manual introduction, for which more details will be given at a later stage in the text. The retaining parts, which are formed on the inner wall surface of the sleeve-like body and may have different configurations, then secure the tool in the hanging element by latching into the flutes formed in the tool shank, the shank end section adjacent to the end surface of the tool shank projecting beyond the top border of the sleeve-like body.

The subject matter of the present invention can be gathered not only from the subject matter of the individual patent claims but also from the combination of the individual patent claims with one another.

All the details and features disclosed in the documents, including the abstract, in particular the three-dimensional design illustrated in the drawings, are claimed as being essential to the invention insofar as they are novel, individually or in combination, with respect to the prior art.

The invention is explained in more detail hereinbelow with reference to drawings which illustrate a number of different embodiments. Further features which are essential to the invention and advantages of the invention can be gathered from the drawings and the description thereof.

Figure 1:
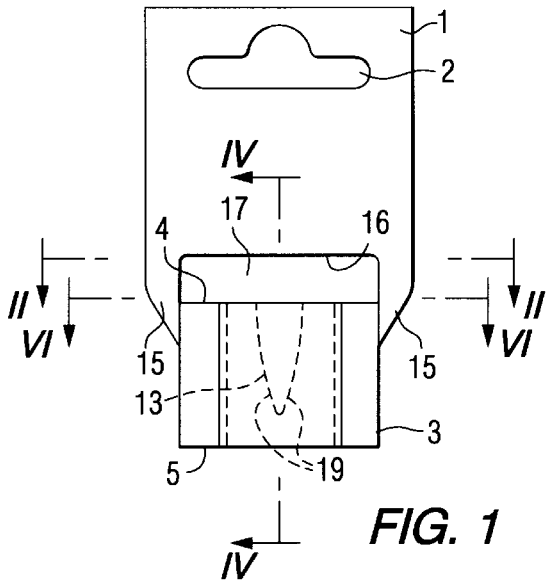
FIG. 1 shows a view of a first embodiment of the hanging element.

The hanging element according to the invention has a plate-like hanging lug 1 with a hanging hole 2. Fitted on the hanging lug 1 is a sleeve-like body 30 (FIGS. 10–13) which has either a circular or oval cross-section in the rest state and has a top border 4 and a bottom border 5.

Figure 4:
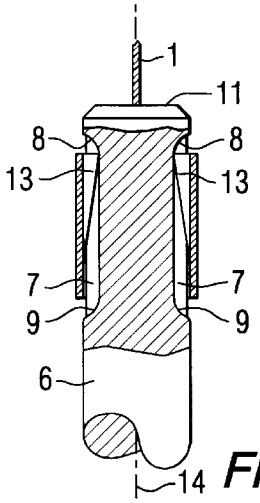
FIG. 4 shows the section along line IV—IV in FIG. 1 with the tool shank introduced into the hanging element to the full extent and retained therein.
Figure 10:
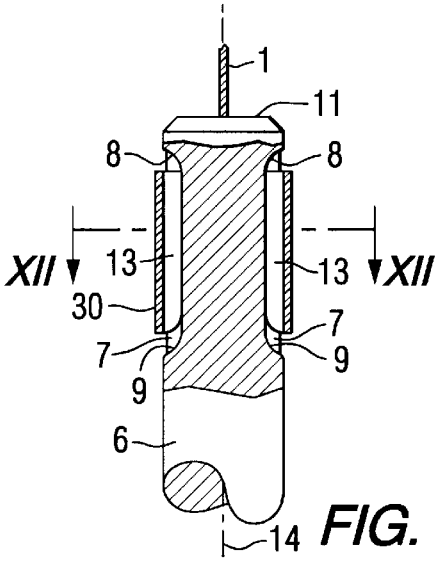
FIG. 10 shows the section along line X—X in FIG. 8 with the tool shank introduced into the hanging element to the full extent and retained therein.
Figure 11:
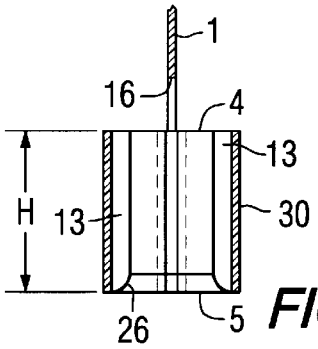
FIG. 11 shows the section along line X—X in FIG. 8 without the tool shank.

The hanging lug 1 of the hanging element serves for securely retaining the shank 6 of a tool which is to be hung and is designed for being fastened in an SDS-plus holder or a similar holder of a machine tool (power tool). Such a shank 6 has two flutes 7, which are arranged diametrically opposite one another and parallel to the longitudinal axis 14 of the shank, and longitudinal grooves 10, which are spaced apart from the flutes by an angle. The flutes 7 are of a cross sectionally arcuate or trough-shaped configuration and, on both sides, terminate within the shank via a top or outer rounded end surface 8 and an inner or bottom rounded end surface 9, these surfaces 8 and 9 merging into the cylindrical shank surface, as is shown in FIGS. 4 and 10. The longitudinal grooves 10 have a rectangular or trapezoidal cross-section and terminate, on one side, within the shank, approximately in the region of the inner end surface 9 of the flutes 7, and, on the other side, in the end surface 11 of the shank 6, i.e. they are open in this end surface.

The annular element, which tightly encloses the tool shank 6, is formed as a sleeve-like body 3 or 30 from an elastic material. On its inner wall surface, this body 3 or 30 has at least one retaining part 13, which engages in one of the flutes 7 configured in the tool shank 6. However, the hanging element according to the invention preferably has two such retaining parts 13 arranged diametrically opposite one another. In the rest state of the hanging element, said body 3 or 30 has a circular or oval cross-section, respectively, which, at two diametrically opposite regions outside the circumferential surface of the shank 6, forms, with the inner wall surface of the sleeve-like body 3 or 30, in each case one clearance 20 over the entire height H of said body, said clearances being spaced apart, by an angle of 90° in each case, from the at least one retaining part 13 or from the two retaining parts 13. These clearances 20 permit elastic deformation of the sleeve-like body 3 or 30 along with frictionally locking pressurized abutment, at all times, of parts of the inner wall surface of said body against the circumferential surface of the shank 6.

Figure 5:
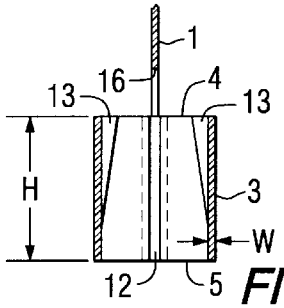
FIG. 5 shows the section through the hanging element along line IV—IV in FIG. 1 without the tool shank.
Figure 2:
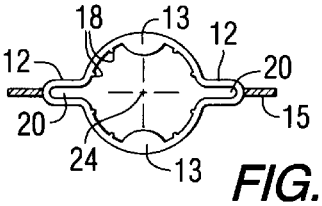
FIG. 2 shows the section along line II—II in FIG. 1.

The wall which determines the sleeve-like body 3 in the embodiments of FIGS. 1–9 and FIGS. 14 and 15 is configured, at two diametrically opposite locations, over the entire height H with in each case one cross-sectionally U-shaped bulge or fold 12 which encloses the clearance 20 and, in the rest state of the hanging element, is formed by two spaced-apart wall surfaces which are located opposite one another and are preferably parallel to one another, as is shown in FIGS. 2, 9, 14 and 15. In the rest state of the hanging element, the distance between the mutually opposite inner surfaces of the bulges 12 is at least equal to double the wall thickness W (FIG. 5) of the sleeve-like body 3. The retaining parts 13, which are formed on the inner wall surface of the sleeve-like body 3 at two diametrically opposite locations, which are spaced apart by 90° from the bulges 12, protrude, as FIGS. 4 and 5 show, in the form of a wedge in longitudinal section in this case and taper from the top border 4 of the sleeve-like body 3 to the bottom border 5. Furthermore, in this embodiment, the two lateral edges or borders 19 of the retaining parts 13 converge with respect to one another in the direction from the top border 4 of the body 3 to the bottom border 5, with the result that the retaining parts 13 are configured in the form of lancets, as is shown in FIG. 1. The bottom end of these lancet-like retaining parts 13 merges steplessly and smoothly into the inner wall of the sleeve-like body 3, to be precise preferably in a region which is spaced apart from the bottom border 5 by a distance which corresponds to a quarter to a third of the height H of the sleeve-like body 3. Provided above the top border 4 of the sleeve-like body 3 is a free space 17, into which the top, free end of the shank 6 can enter with a certain freedom of movement if the shank is accommodated correctly in the hanging element, as FIG. 4 shows.

At the top border 4 of the body 3—measured in a plane which encloses the longitudinal axis 24 of the latter—the thickness of the lancet-like retaining parts 13 is at least two and a half times the wall thickness W of the body 3, in order to provide a reliable support for the outer or top end surface 8 of the flutes 7.

Figure 8:
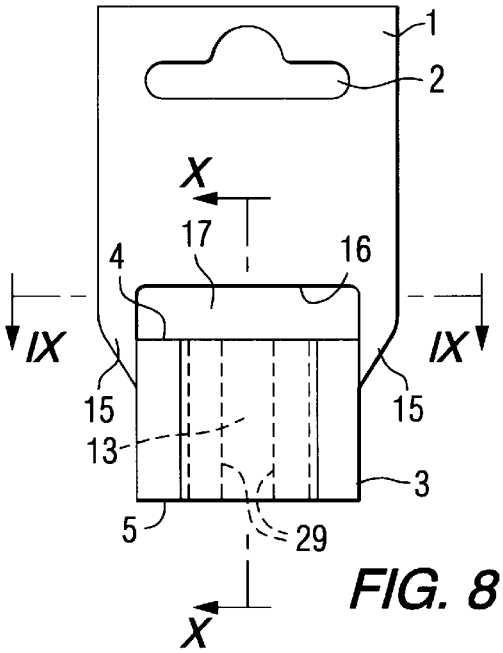
FIG. 8 shows a view of a second embodiment of the hanging element.

The hanging lug 1 is preferably connected to the outer surfaces of the bulges 12, or of the bodies 3, 30, via webs 15, the intention being for said webs 15 to terminate at least in the center of the height H of the sleeve-like body 3, 30, as is shown in FIGS. 1 and 8, but preferably to extend further to the bottom border of the body 3, 30 since they form grips for the purpose of turning the sleeve-like body 3, 30, for which more details will be given at a later stage in the text.

For the purpose of compensating for small differences in tolerance in the shank diameter, it is possible for small elevations 18 to be distributed arbitrarily over the inner wall of the sleeve-like body 3 or 30.

The hanging element is produced in one piece from an elastically deformable material, with the result that, once a force which purely causes deformation has been eliminated, the element tries to return to its original configuration, which it has in the rest state.

Figure 6:
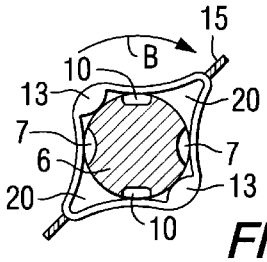
FIG. 6 shows a section, taken level with line VI—VI in FIG. 1 and with the tool shank introduced, the view showing an intermediate stage for separating the hanging element and tool shank.
Figure 7:
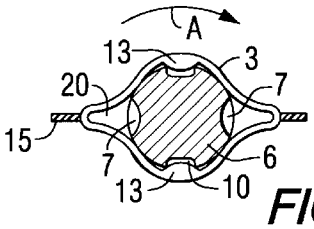
FIG. 7 show a section along line VI—VI in FIG. 1 with the tool shank introduced, the view showing an initial stage for connecting the hanging element and tool shank or the end stage for separating the hanging element and tool shank.

In order to accommodate a tool shank when the hanging element is fitted manually, the hanging element is moved into the position shown in FIG. 7, the lancet-like retaining parts 13 coinciding with the longitudinal grooves 10, which are open on the endside, and then the shank 6 is pushed into the sleeve-like body 3 until such time as the end surface 11 of the shank 6 projects beyond the top border 4, as FIG. 4 shows, it being possible for the bottom edge 16 of the hanging lug 1 to serve as a stop for the end surface 11. Thereafter, the hanging element is turned in the direction of the arrow A in FIG. 7, the webs 15 and/or the hanging lug 1 serving as grips, with the result that the retaining parts 13 latch into the flutes 7 and the state shown in FIG. 4 is produced. In order to release the tool from the hanging element, the latter is turned in the direction of the arrow B in FIG. 6 in order to move the retaining parts 13 into the longitudinal grooves 10, with the result that the tool shank can be easily drawn out of the sleeve-like body 3.

Figure 3:
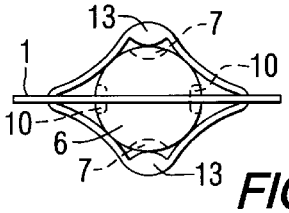
FIG. 3 shows a plan view of the hanging element in the stage where a tool shank is being introduced mechanically.

FIG. 3 shows the plan view of an initial state in the automated or mechanical fitting of the hanging element, a pneumatic means, for example, being used to apply to the hanging element, whose retaining parts 13 in this case coincide with the flutes 7, a pressure which has to be higher than a pressure which can be applied manually in the axial direction of the hanging element, in order to introduce the retaining parts 13, over the top shank end, directly into the flutes 7. The operation for separating the hanging element and the tool is carried out manually, as has been described above in conjunction with FIG. 6.

As can be seen from the cross-sections of FIGS. 3, 6 and 7, the bulges or folds 12 provide the sleeve-like body 3 with such elasticity that deformation of wall sections of said body 3, these wall sections being cylindrical in the rest state, results in the retaining parts 13 entering tightly into the longitudinal grooves 10 in order for the sleeve-like body 3 to be slipped over the shank 6, the body 3 being turned tightly and, finally, the retaining parts 13 engaging in a positively locking manner in the flutes 7, which are closed off by means of the end surface 8 adjacent to the end surface 11 of the shank 6, with the result that the shank 6 of the tool is secured satisfactorily and reliably in the hanging element, but can easily be removed again from said hanging element if required.

In the embodiment shown in FIGS. 10–13, the sleeve-like body 30 has essentially an oval cross-section in the rest state of the hanging element, the clearances 20 at two diametrically opposite locations of said body 30 being configured as sickle-shaped spaces which are delimited between the circumferential wall of the shank 6 and the inner wall of the sleeve-like body 30.

The function of this embodiment is essentially the same as that which has been described above with reference to FIGS. 1–7.

Figure 9:
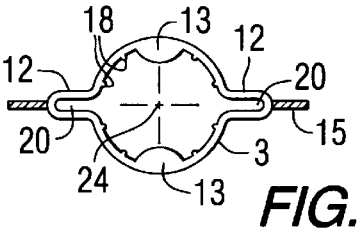
FIG. 9 shows a section along line IX—IX in FIG. 8.
Figure 12:
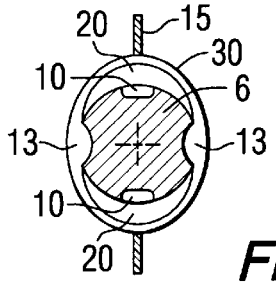
FIG. 12 shows the section along line XII—XII in FIG. 10.
Figure 14:
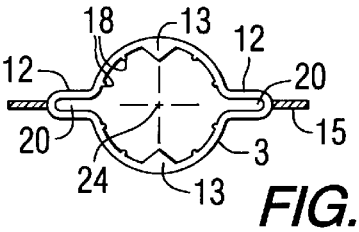
FIGS. 14 and 15 show, in illustrations which are similar to FIG. 9, modified embodiments of retaining parts.
Figure 13:
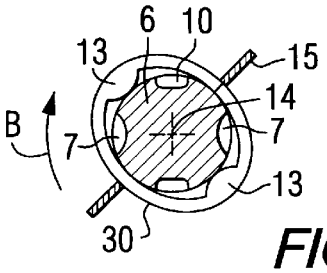
FIG. 13 shows a section similar to FIG. 12, the view showing an intermediate stage for separating the hanging element and tool shank.
Figure 15:
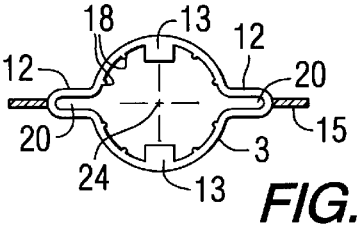
Figure 16:
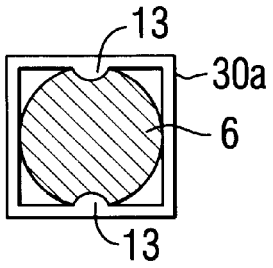
FIGS. 16 to 21 show further possible embodiments in illustrations similar to FIGS. 12 and 13.
Figure 17:
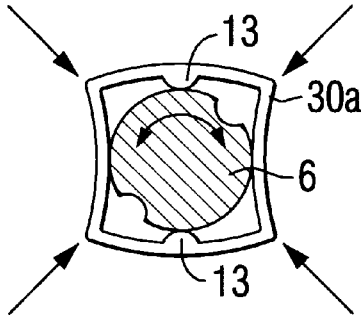
Figure 18:
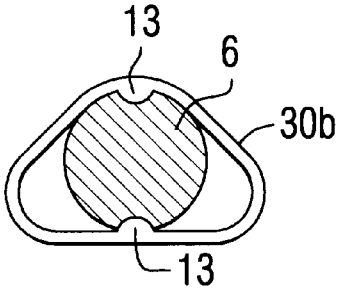
Figure 19:
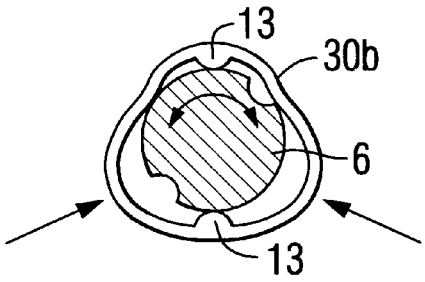
Figure 20:
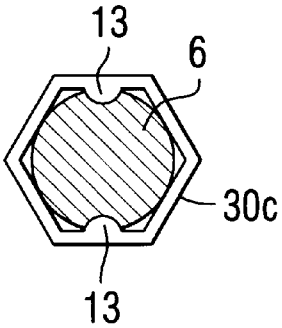
Figure 21:
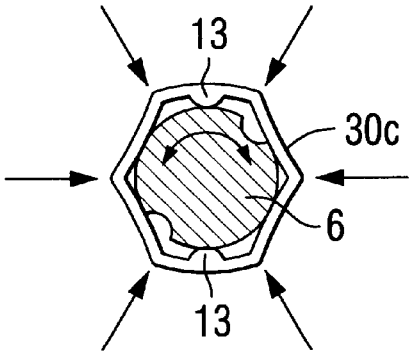

In the embodiments shown in FIGS. 8 and 9 and in FIGS. 14 and 15, the retaining part 13 protruding from the inner wall surface of the sleeve-like body 3 has, in the case of FIGS. 8 and 9, an arcuate configuration in the cross-section taken at right angles to the longitudinal axis 24 of said body, whereas, in the case of FIG. 14, the cross-section is triangular and, in the case of FIG. 15, the retaining part 13 has a rectangular cross-section.

The protruding retaining parts 13 preferably merge into the inner wall surface of the sleeve-like body via a slope or bevel 26, which is formed at a small distance from the bottom border 5 of said body. This slope or bevel 26 may also extend directly from the bottom border 5. In both cases, the operation of introducing the tool shank 6 into the sleeve-like body is facilitated as a result.

The free space 17 which is defined between the top border 4 of the sleeve-like body 3 or 30 and the bottom edge 16 of the hanging lug 1 is preferably dimensioned such th at the tool accommodated in the hanging element has a certain freedom of movement, of approximately 1 to 2 mm, in the direction of its axis 14.

It has been found that, for the frictionally locking pressurized abutment of the sleeve-like body 3 against the circumferential surface of the shank and for stable accommodation of the shank in the sleeve-like body, it is advantageous if the distance between the mutually opposite inner surfaces of the U-shaped bulges 12 in the rest state of the hanging element is at least equal to double the wall thickness W of the sleeve-like body 3, 30, and the spaced apart, mutually opposite surfaces of the U-shaped bulges 12 preferably run parallel to one another in the non-deformed state of the hanging element.

It is preferred for the axial extent H of the sleeve-like body 3, which has a circular cross-section in the rest state, to be at least equal to the internal diameter of said body in a non-deformed state of the hanging element.

The axial extent H of the sleeve-like body 30, which has an oval cross-section in the rest state, is preferably equal to the dimension of the small axis of the oval in a non-deformed state of the hanging element.

The two last-mentioned conditions ensure sufficient stability of the hanging element in comparison with merely a narrow ring for the respective tools which, in dependence on their diameters at the machining end, generally have different shank diameters, differing tool lengths and, as a result, varying dimensions, which the hanging element has to allow for.

Three further embodiments for the body 30*a*, 30*b*, 30*c* are illustrated in FIGS. 16–21. Two protrusions 13 are provided in each case. The arrows show the deformation of the respective body 30*a*, 30*b*, 30*c* when the shank 6 is turned.

The invention thus discloses a hanging element which is intended for tools with a shank 6 for an SDS-holder on a machine tool and has a sleeve-like body 3 or 30 fitted on a plate-like hanging lug 1. The sleeve-like body, which is circular or oval in cross-section, is provided, at two diametrically opposite locations, with extensions 12 and 20, which provide clearances between the inner wall of the body 3 or 30 and the circumferential surface of the tool shank 6 and make it possible for the sleeve-like body 3, 30 to deform elastically. Formed at two diametrically opposite locations, which are spaced apart from the clearances 20 by 90°, are retaining parts 13 which protrude from the inner wall of the sleeve-like bodies and engage with flutes 7 which are configured in the tool shank 6 and are closed off with respect to the end surface 11 of the shank, with the result that the hanging element is connected firmly to the tool shank 6. By virtue of the sleeve-like body 3 or 30 being turned around the tool shank, the retaining parts 13 enter into, or emerge from, the flutes 7 of the shank.

| Key to the Drawings |
|---|
| 1 Hanging lug |
| 2 Hanging hole |
| 3 Body |
| 4 Border |
| 5 Border |
| 6 Shank |
| 7 Flute |
| 8 End surface |
| 9 End surface |
| 10 Longitudinal groove |
| 11 End surface |
| 12 Bulge |
| 13 Retaining part |
| 14 Longitudinal axis |
| 15 Web |
| 16 Bottom edge |
| 17 Space |
| 18 Elevation |
| 19 Edge, border |
| 20 Clearance |
| 24 Longitudinal axis |
| 26 Bevel |
| 30 Body |

I claim:

1. A hanging element for use with tools having an SDS-shank that has a circumferential surface and that also includes at least one flute that is closed at the top of the shank, said element comprising:

a hanging lug with a hole, and a substantially annular body that defines an inner wall surface and an outer surface between a top border and a bottom border, with the top border being located adjacent to the hanging lug, said body being elastically deformable and also being suitable for receiving the the SDS-shank in the interior of said body, said body further including;

at least one protrusion on the inner wall, said protrusion engaging the flute of the SDS-shank to retain the tool in said body, and at least two bulges, wherein in each of said bulges the inner wall surface of the body is in the form of two oppositely located wall surfaces that are spaced apart to define a clearance therebetween, said clearances being located substantially opposite one another, said clearances allowing the body to deform at times when the SDS-shank is received in the interior of the body to maintain the protrusion in pressurized abutment with the circumferential surface of the shank and also to positively engage the protrusion in the flute of the SDS-shank to secure the tool in the hanging element.

2. The hanging element of claim 1, wherein said annular body is substantially round.

3. The hanging element of claim 2 wherein said bulges are U-shaped bulges that have oppositely located wall surfaces.

4. The hanging element as claimed in claim 1, wherein said at least one protrusion extends between the top border and the bottom border of said body.

5. The hanging element as claimed in claim 4, wherein said at least one protrusion is beveled.

6. The hanging element as claimed in claim 1, wherein said at least one protrusion is generally in the form of a wedge and partially extends between the top border and the bottom border of said body.

7. The hanging element as claimed in claim 1, wherein the thickness of said at least one protrusion at the upper border of said body is at least two and a half times the wall thickness of the body.

8. The hanging element as claimed in claim 1, wherein the inside width between said clearances corresponds at least to double the wall thickness of said body.

9. The hanging element as claimed in claim 1, wherein said hanging lug includes webs that are connected to said body, said webs extending from the top border to at least the center of said body.

10. The hanging element as claimed in claim 8, wherein said webs are offset by substantially 90° with respect to the clearances.

11. The hanging element as claimed in claim 1, wherein the inner wall of said body is further provided with a plurality of stud-like elevations that are small in comparison to said at least one protrusion.

12. The hanging element as claimed in claim 1, wherein the length of said body between the top border and the bottom border is substantially equal to its internal diameter in the non-deformed state.

13. The hanging element of claim 1 wherein the space between the mutually opposite inner surfaces of the bulges in the body at times when the body is in the non-deformed state is equivalent to at least twice the thickness of the annular body between the inner wall surface and the outer surface.

14. The hanging element of claim 13 or 3 wherein the oppositely located wall surfaces are substantially parallel surfaces at times when the body is in the non-deformed state.

15. The hanging element of claim 1, 4, 5 or 6 wherein the cross-section of said annular body is substantially oval.

16. The hanging element of claim 1, 4, 5 or 6 wherein the cross-section of said annular body is substantially polygonal.

17. The hanging element as claimed in claim 15 wherein the length of said body between the top border and the bottom border is substantially equal to the internal dimension along the minor axis of the oval in the non-deformed state.

18. A hanging element for use with tools having with an SDS-shank that includes at least one groove that opens at the top of the shank and that also includes at least two flutes that are closed at the top of the shank, said element comprising:

a hanging lug with a hole, and a substantially annular body that defines an inner wall surface and an outer surface between a top border and a bottom border, with the top border being located adjacent to the hanging lug, said body being elastically deformable and also being suitable for receiving the SDS-shank in the interior of said body, said body further including;

at least one protrusion on the inner wall, said protrusion engaging the open-top groove of the SDS-shank at times when the tool is in a first position and travels in the direction between the top border and the bottom border, said protrusion also engaging the flutes of the SDS-shaft at time when the tool is in a second position to retain the tool in said body, and at least two bulges, wherein in each of said bulges the inner wall surface of the body is in the form of two oppositely located wall surfaces that are spaced apart to define a clearance therebetween, said clearances being located substantially opposite one another, said clearances allowing the body to deform in response to turning said tool between a first position wherein the protrusion engages the groove of the SDS-shank and a second position wherein the protrusion engages the flutes of the SDS-shank.

19. The hanging element of claim 18, wherein said annular body is substantially round.

20. The hanging element of claim 19 wherein said bulges are U-shaped bulges that have oppositely located wall surfaces.

21. The hanging element as claimed in claim 18, wherein said at least one protrusion extends between the top border and the bottom border of said body.

22. The hanging element as claimed in claim 18, wherein said at least one protrusion is generally in the form of a wedge and partially extends between the top border and the bottom border of said body.

23. The hanging element as claimed in claim 18, wherein the thickness of said at least one protrusion at the upper border of said body is at least two and a half times the wall thickness of the body.

24. The hanging element as claimed in claim 18, wherein said hanging lug includes webs that are connected to said body, said webs extending from the top border to at least the center of said body.

25. The hanging element as claimed in claim 18, wherein the inner wall of said body is further provided with a plurality of stud-like elevations that are small in comparison to said at least one protrusion.

26. The hanging element as claimed in claim 25, wherein said webs are offset by substantially 90° with respect to the clearances.

27. The hanging element as claimed in claim 18, wherein the length of said body between the top border and the bottom border is substantially equal to its internal diameter in the non-deformed state.

28. The hanging element of claim 18 wherein the space between the mutually opposite inner surfaces of the bulges in the body at times when the body is in the non-deformed state is equivalent to at least twice the thickness of the annular body between the inner wall surface and the outer surface.

29. The hanging element of claim 28 or 20 wherein the oppositely located wall surfaces are substantially parallel surfaces at times when the body is in the non-deformed state.

30. The hanging element of claim 18, 21, 22 or 23 wherein the cross-section of said annular body is substantially oval.

31. The hanging element as claimed in claim 30 wherein the length of said body between the top border and the bottom border is substantially equal to the internal dimension along the minor axis of the oval in the non-deformed state.

32. The hanging element of claim 18, 21, 22 or 23 wherein the cross-section of said annular body is substantially polygonal.

* * * * *